US006164411A

United States Patent [19]

Zoccola, Jr.

[11] Patent Number: 6,164,411

[45] Date of Patent: Dec. 26, 2000

[54] SUPPRESSION OF ACOUSTIC CAVITY RESONANCE INDUCED BY FLUID FLOW

[75] Inventor: Paul J. Zoccola, Jr., Gaithersburg, Md.

[73] Assignee: The United States of America as represented by the Secretary of the Navy, Washington, D.C.

[21] Appl. No.: 09/368,186

[22] Filed: Aug. 4, 1999

[51] Int. Cl.[7] ..... F01N 1/00

[52] U.S. Cl. ..... 181/255; 181/250

[58] Field of Search ..... 181/224, 229, 181/250, 255, 269, 273, 276

[56] References Cited

U.S. PATENT DOCUMENTS

| | | | |
|---|---|---|---|
| 2,989,136 | 6/1961 | Wohlberg | 181/250 |
| 5,349,141 | 9/1994 | Horibe et al. | 181/224 |
| 5,625,172 | 4/1997 | Blichmann et al. | 181/224 |

*Primary Examiner*—Khanh Dang
*Attorney, Agent, or Firm*—John Forrest; Jacob Shuster

[57] ABSTRACT

A flow modifying element is fixedly positioned on a cavity enclosure over a forward portion of an opening therein through which the cavity is exposed to fluid undergoing flow above the opening. Some of such fluid is thereby diverted into the cavity to suppress acoustic oscillations caused by flow-induced cavity resonance.

7 Claims, 1 Drawing Sheet

SUPPRESSION OF ACOUSTIC CAVITY RESONANCE INDUCED BY FLUID FLOW

The present invention relates generally to suppression of acoustic oscillations produced by grazing flow over a cavity opening.

BACKGROUND OF THE INVENTION

Fluid flow induced cavity resonance is a source of unwanted noise and vibration which occurs during travel of vehicles such as marine vessels, automobiles and aircraft as well as during flow of fluid through certain pipe systems. Such acoustic problem arises when fluid within an opening in a structural portion of the vehicle through which an enclosed cavity is exposed to the fluid, becomes unstable so as to excite cavity resonance. Various methods have been utilized and/or proposed in order to reduce or eliminate the cavity resonance condition, including installation of slatted louvers in the opening, use of spoilers or flaps at the leading edge of the opening or use of a ramp shaped trailing edge for the opening. Such structural solutions to the problem have various operational limitations and adverse affects such as blocking the opening and increasing broadband noise. Other solutions to the foregoing acoustical problem involve costly installation of electronic equipment which not only adds to the vehicle weight but does not completely eliminate the acoustic oscillations.

It is therefore an important object of the present invention to more completely eliminate cavity resonance without use of costly electronic equipment heretofore utilized, and without blockage of the opening or causing other unwanted noises.

SUMMARY OF THE INVENTION

In accordance with the present invention, a cross-sectionally triangular flow modifying element is fixedly positioned on the top external surface of a cavity enclosure, covering a forward portion of the opening therein through which the cavity is exposed to fluid undergoing flow over the top surface of the enclosure and the opening therein from a leading edge established by the flow modifying element downstream from a flow diverting knife-edge spaced a predetermined height above the top surface to accommodate diverted inflow of the fluid into the cavity from a location upstream of the established leading edge of the opening to thereby disrupt the fluid instability inducing cavity resonance which otherwise normally occurs.

BRIEF DESCRIPTION OF DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
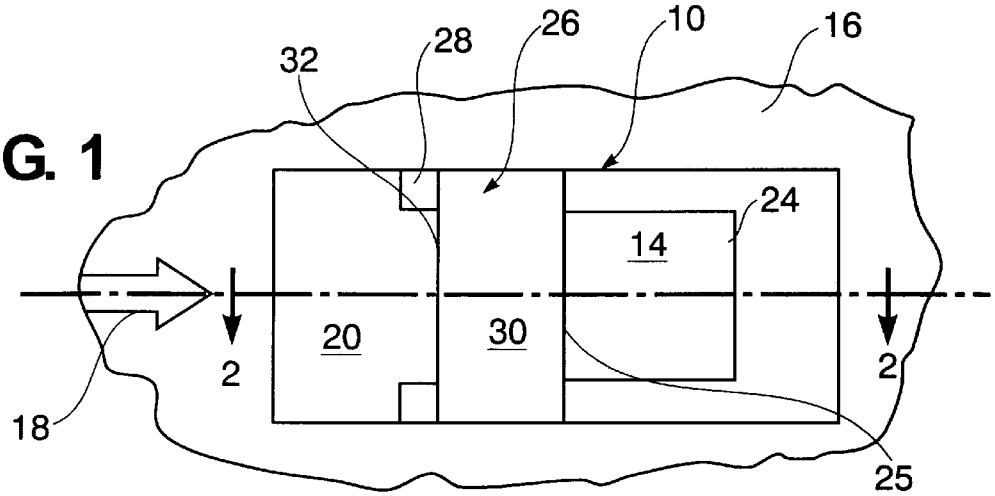
FIG. 1 is a top plan view of a cavity enclosure within a body of seawater, with an inflow modifying device positioned thereon in accordance with one embodiment of the invention.
Figure 2:
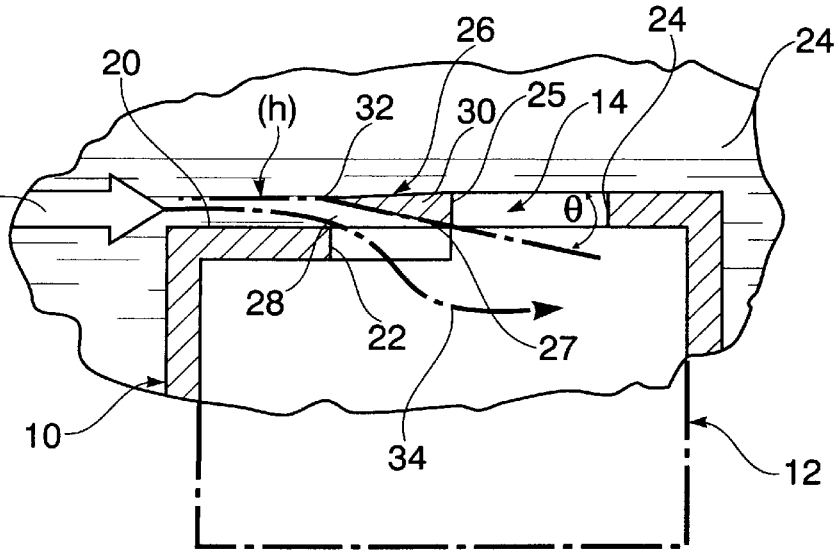
FIG. 2 is a partial section view taken substantially through a plane indicated by section line 2—2 in FIG. 1.
Figure 3:
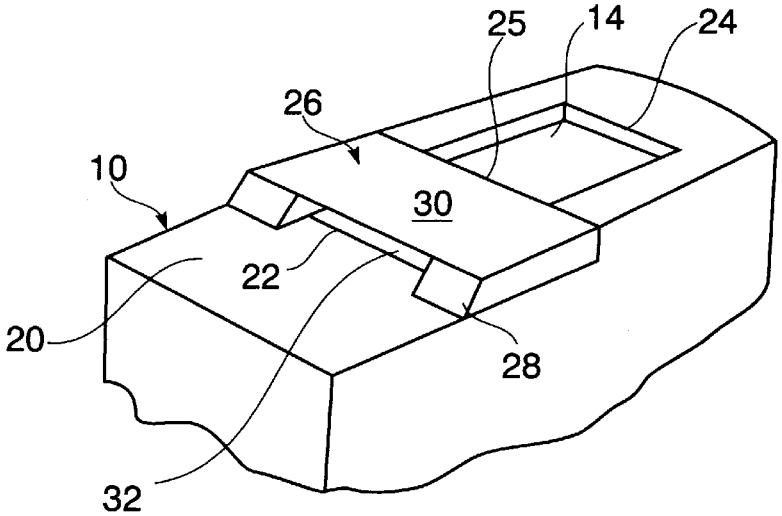
FIG. 3 is a perspective view of the cavity enclosure with the inflow modifying device thereon as shown in FIGS. 1 and 2.

Referring now to the drawing in detail, an enclosure 10 is illustrated within which an internal cavity 12 is formed, having some predetermined volume. The cavity 12 is exposed through an opening 14 in the enclosure 10 to ambient fluid 16 such as seawater as shown in FIGS. 1 and 2, which also indicates by means of arrow 18 directional flow of such fluid relative to the enclosure 10. Flow of such fluid in the case of a seawater environment, is induced by movement of the enclosure 10 being carried on a marine vessel during travel thereof. Accordingly, flow of the fluid 16 occurs along a forward primary surface 20 of the enclosure 10, inducing fluid instability within the cavity opening 14 reflected by oscillating movement of such fluid within the opening.

In accordance with the present invention, acoustic resonance ordinarily induced by instability of the fluid within the opening 14 in the enclosure 10 is modified by a laterally elongated element 26 fixedly positioned externally on the enclosure 10, bridging a forward portion of the opening 14 from its leading edge 22. The element 26 is attached at its opposite ends to the enclosure surface 20 by tapered end portions 28, between which a cross-sectionally triangular portion 30 extends from a leading knife-edge 32 between the side edges of the opening to a newly established leading edge 25 for the opening 14, rearwardly spaced from and above edge 22. As shown in FIG. 2, the new leading edge 25 is in alignment with trailing edge 24 of the opening. Such flow modifying portion 30 of the element 26 has an underlying surface 27 extending rearwardly upstream in the direction of flow from the forward knife-edge 32 at an angle $\theta$ of 14°, with the edge 32 being spaced above the enclosure top surface 20 at the edge 22 of the opening 14 by a height (h), as indicated in FIG. 2. Such height (h) is approximately 1/10 of the boundary layer thickness of the fluid 16 in the case of seawater under flow along the top surfaces of the enclosure 10.

As a result of the foregoing described fluid flow modifying arrangement, a portion of the approaching fluid, otherwise affecting inflow into the cavity 12 between the leading and trailing edges 25 and 24 of the opening 14, is diverted at edge 32 for flow into the cavity along an inflow path 34 as denoted in FIG. 2. Such inflow diversion of fluid disrupts the instability inducing processes otherwise associated with a cavity opening normally causing flow-induced acoustic resonance as a source of noise and vibration.

Obviously, other modifications and variations of the present invention may be possible in light of the foregoing teachings. It is therefore to be understood that within the scope of the appended claims the invention may be practiced otherwise than as specifically described.

What is claimed is:

1. In combination with an enclosure having a cavity formed internally therein and is exposed to fluid undergoing flow relative to an external surface of the enclosure, means for suppressing acoustic resonance induced by said flow of the fluid as a source of noise and vibration, comprising: an opening into the cavity formed in the external surface of the enclosure having a forward portion in direction of said flow of the fluid; and flow modifying means fixedly positioned on the external surface of the enclosure above said forward portion of the opening for diverting a portion of said flow of the fluid into the cavity.

2. The combination as defined in claim 1, wherein said flow modifying means includes a trailing edge in alignment with a rearward portion of the opening in said direction of the flow of the fluid.

3. In combination with an enclosure having an opening therein through which a cavity formed internally within the enclosure is exposed to fluid undergoing flow relative to an external surface of the enclosure, a device for suppressing acoustic resonance induced by said flow of the fluid as a source of noise and vibration, comprising: flow modifying means fixedly positioned on the external surface of the enclosure above the opening for diverting a portion of said flow of the fluid into the cavity, said flow modifying means including an element bridging the opening along a forward portion thereof, having an edge spaced above said external surface of the enclosure by a predetermined height and an underlying surface extending rearwardly upstream therefrom at an angle to said external surface of the enclosure.

4. The flow modifying means as defined in claim 3, wherein said predetermined height is approximately 1/10 of boundary layer thickness of the fluid on the external surface of the enclosure.

5. The flow modifying means as defined in claim 4, wherein said angle of the underlying surface of the element is 14°.

6. The flow modifying means as defined in claim 3, wherein said angle of the underlying surface of the element 14°.

7. In combination with an enclosure having an opening therein through which a cavity formed internally within the enclosure is exposed to fluid undergoing flow relative to an external surface of the enclosure, a device for suppressing acoustic resonance induced by said flow of the fluid as a source of noise and vibration, comprising: flow modifying means fixedly positioned on the external surface of the enclosure above the opening for diverting a portion of said flow of the fluid into the cavity, said flow modifying means including a cross-sectionally triangular element having a knife-edge from which an underlying surface rearwardly extends; and means fixedly positioning the element on the enclosure to space the knife-edge above a forward portion of the opening for establishing a leading edge of the opening upstream of the knife-edge while diverting inflow of the fluid from the knife-edge into the opening below said underlying surface.

* * * * *